US011867021B2

(12) United States Patent
Guzman

(10) Patent No.: US 11,867,021 B2
(45) Date of Patent: Jan. 9, 2024

(54) OFF-BOTTOM CEMENTING POD

(71) Applicant: SAUDI ARABIAN OIL COMPANY, Dhahran (SA)

(72) Inventor: Julio C. Guzman, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/730,559

(22) Filed: Apr. 27, 2022

(65) Prior Publication Data

US 2023/0349260 A1 Nov. 2, 2023

(51) Int. Cl.
*E21B 33/14* (2006.01)
*E21B 34/06* (2006.01)

(52) U.S. Cl.
CPC ..... *E21B 33/14* (2013.01); *E21B 34/063* (2013.01)

(58) Field of Classification Search
CPC ..... E21B 33/14; E21B 33/146; E21B 33/16; E21B 34/063
See application file for complete search history.

(56) References Cited

U.S. PATENT DOCUMENTS 1,050,244 A * 1/1913 Smith ..... E21B 33/14 166/380
1,460,632 A * 7/1923 Wigle ..... E21B 17/1078 175/323
1,673,616 A * 6/1928 Boynton ..... E21B 33/14 166/290
1,858,215 A * 5/1932 Baker ..... E21B 33/12 166/132
2,407,983 A * 9/1946 Harper ..... E21B 33/146 285/396
2,925,865 A * 2/1960 Oliver ..... E21B 33/16 166/117
3,768,562 A 10/1973 Baker
3,948,322 A * 4/1976 Baker ..... E21B 33/127 166/187
4,450,912 A * 5/1984 Callihan ..... E21B 33/146 166/290
4,595,058 A * 6/1986 Nations ..... E21B 17/22 166/380
4,600,056 A * 7/1986 Burton, Jr. ..... E21B 33/12 166/387
5,024,273 A * 6/1991 Coone ..... E21B 33/127 166/383
5,718,288 A * 2/1998 Bertet ..... E21B 33/14 166/290

(Continued)

FOREIGN PATENT DOCUMENTS

CA 2 832 071 C 9/2015
EP 2800865 B1 * 7/2018 ..... E21B 33/124
GB 2526208 B 9/2017

*Primary Examiner* — Aaron L Lembo
(74) *Attorney, Agent, or Firm* — Osha Bergman Watanabe & Burton LLP

(57) ABSTRACT

A cementing pod is disclosed. The cementing pod includes a cylindrical housing with a first end and a second end, and a throughbore disposed through the cylindrical housing in a first axial direction from the first end to the second end. The cementing pod further includes a plurality of openings disposed through the cylindrical housing into the throughbore in a second axial direction, and a solid fill disposed at the second end of the cylindrical housing.

18 Claims, 10 Drawing Sheets

(56) References Cited

U.S. PATENT DOCUMENTS

| | | | | |
|---|---|---|---|---|
| 7,748,463 | B2 * | 7/2010 | Revheim | E21B 34/12 166/332.4 |
| 8,479,818 | B2 * | 7/2013 | Rayssiguier | E21B 33/1277 166/290 |
| 9,765,577 | B2 * | 9/2017 | Dicke | E21B 17/1078 |
| 9,784,071 | B2 * | 10/2017 | Byberg | E21B 33/16 |
| 9,869,157 | B2 | 1/2018 | Sevadjian et al. | |
| 10,253,591 | B2 * | 4/2019 | Hazel | E21B 33/14 |
| 11,261,704 | B2 * | 3/2022 | Anderson | E21B 37/00 |
| 2012/0325475 | A1 * | 12/2012 | Lee | E21B 34/063 166/285 |

* cited by examiner

OFF-BOTTOM CEMENTING POD

BACKGROUND

In the petroleum industry, wells are drilled into the surface of the Earth to access and produce hydrocarbons. The process of building a well is often split into two parts: drilling and completion. Drilling a well may include using a drilling rig to drill a hole into the ground, trip in at least one string of casing, and cement the casing string in place. The casing string is used to define the structure of the well, provide support for the wellbore walls, and prevent unwanted fluid from being produced. The casing string is cemented in place to prevent formation fluids from exiting the formation and provide further structure for the well.

After a casing string has been placed in the well, the annulus located between the casing string and the wellbore wall must be cemented completely (i.e., to surface) or partially. This is done by pumping cement from the surface, through the inside of the casing string, and up the outside of the casing string (the annulus) to the required height. Oftentimes, the slurry of cement is followed by another type of fluid and/or a wiper plug to push the remainder of the cement out of the inside of the casing and into the annulus, leaving a small amount of cement inside of the casing string. The cement is left to harden before the next section of the well is drilled or the well is completed.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a cementing pod. The cementing pod may include a cylindrical housing with a first end and a second end, and a throughbore disposed through the cylindrical housing in a first axial direction from the first end to the second end. The cementing pod may further include a plurality of openings disposed through the cylindrical housing into the throughbore in a second axial direction, and a solid fill disposed at the second end of the cylindrical housing.

In another aspect, embodiments disclosed herein relate to an off-bottom cementing assembly, which may include a base tubular joint with a first end and a second end, and a cementing pod disposed concentrically around the base tubular joint. The cementing pod may include a cylindrical housing with a third end and a fourth end, a throughbore disposed through the cylindrical housing in a first axial direction from the third end to the fourth end, and an annular region disposed between an inner surface of the throughbore and an outer surface of the base tubular joint. The cementing pod may also include a plurality of openings disposed through the cylindrical housing into the throughbore in a second axial direction, a plurality of metal plates disposed within the annular region, and a communicating port disposed through the base tubular joint into the throughbore in the second axial direction. A solid fill may be disposed at the fourth end of the cylindrical housing.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The size and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1A:
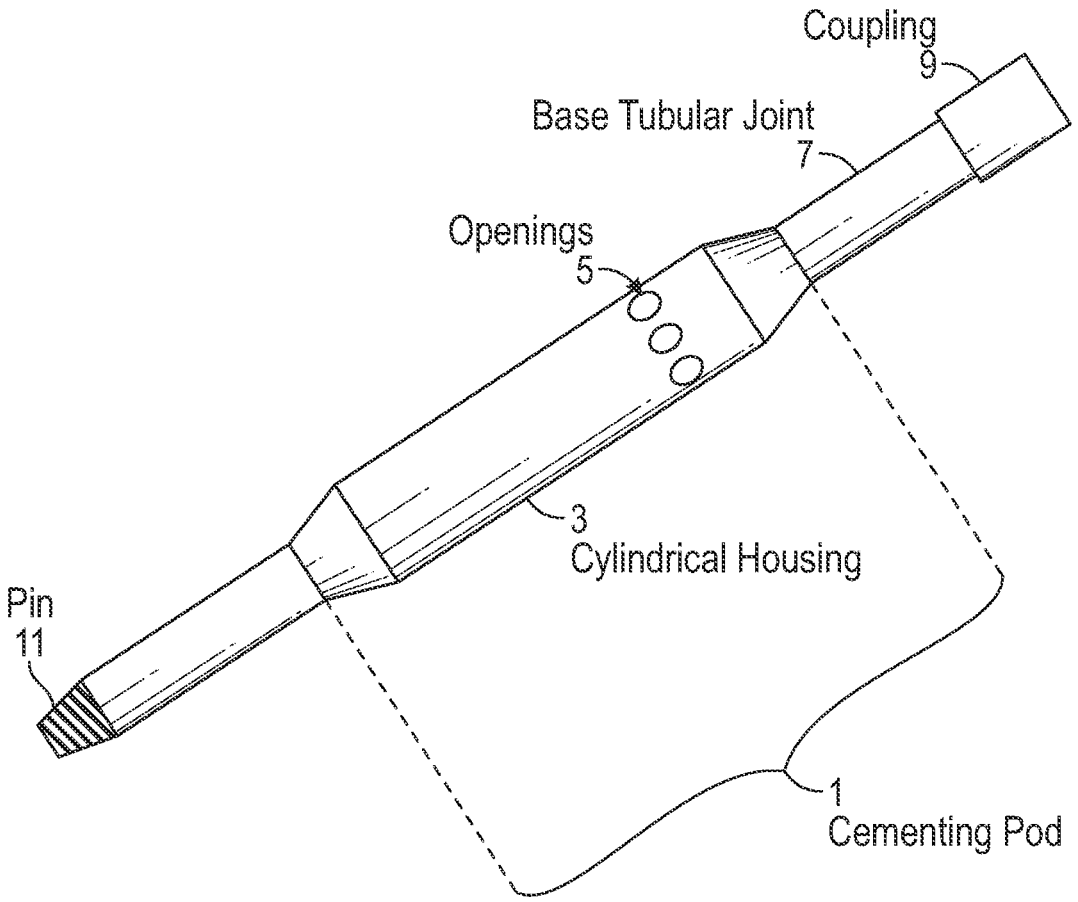
FIGS. 1A and 1B show a cementing pod in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-7, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Disclosed herein are embodiments of apparatuses and methods for off-bottom liner cementing operations. In particular, disclosed herein are embodiments of cementing pods which may be implemented in an off-bottom cementing operation as an alternative to currently existing diverting tools or pressure actuated cementing valves that will improve the overall off-bottom cementing process by reducing the number of elements to be drilled-out after the cement job, hence, reducing the time required to finish the job, the amount of junk left after the drill out and the potential for disconnecting the uncemented portion of the liner. Further, disclosed herein are embodiments of cementing pods which may provide zonal isolation in an upper section of a wellbore and may maintain a lower section of the wellbore open for production or injection.

In one or more embodiments, 'off-bottom' cementing may refer to the process of isolating a problematic or undesirable zone of a hole section drilled in a wellbore. Problematic or undesirable zones may occur in various downhole situations, including sidetracks or re-entries. A tubular section may be run downhole and cemented off-bottom across the undesirable interval, such that the interval is isolated from other regions within the wellbore. In these embodiments, the lower region of the wellbore, which may include the pay-zone, may be left intact and ready for production. In one or more embodiments, the uncemented interval left below the off-bottom tubular may range from 200 feet to 5,000 feet, depending on the type of wellbore. Such an off-bottom cementing method may be performed in both vertical/low inclination wells and horizontal wells.

FIG. 1A depicts a cementing pod 1 which may be utilized in off-bottom cementing operations. The cementing pod 1 may include a hollow cylindrical housing 3, which may be tapered at each end. The cementing pod 1 includes a plurality of openings 5, which may be located along the body of the cylindrical housing 3 or on the tapered ends of the cylindrical housing 3. In one or more embodiments, the cementing pod 1 fits concentrically around a base tubular joint 7, which may have a coupling 9 disposed at one end and a pin 11 disposed at the opposite end. The coupling 9 and the pin 11 may allow the cementing pod assembly to be attached to other components within an off-bottom liner system. The base tubular joint 7 may be any standard casing tubular of sizes typically used in the oil drilling industry. For example, in one or more embodiments, the base tubular joint 7 has a 7 inch or 4.5 inch nominal outer diameter.

Figure 1B:
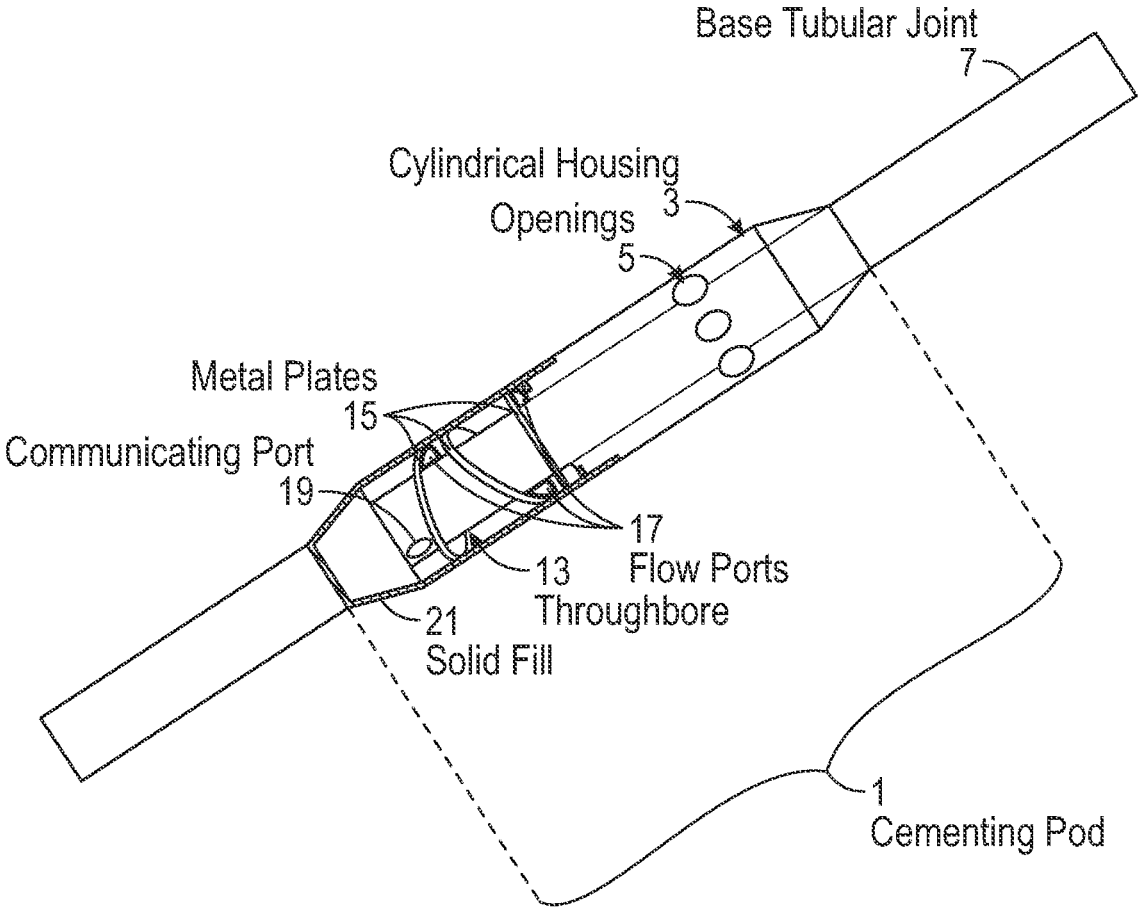

FIG. 1B shows a partial cross-sectional view of the cementing pod 1. The cylindrical housing 3 is hollow, such that a throughbore 13 may extend axially in a first direction through the cylindrical housing 3 from a first end to a second end. The plurality of openings 5 extends axially through the cylindrical housing 3 in a second axial direction. The second axial direction may be perpendicular to the first axial direction. A plurality of metal plates 15 are arranged around the throughbore 13. Each of the plurality of the metal plates 15 may be arranged at a variety of angles and may have a circular cut-out in the center through which the base tubular joint 7 fits. A plurality of flow ports 17 extend through the plurality of metal plates 15 to allow cement flow during cementing operations. The arrangement of the plurality of metal plates 15 forms a plurality of channels, which may direct the flow of cement. The channels may transition from wider geometries to narrower geometries, such that a fluid, such as cement, may be forced to flow around the base tubular joint 7 and the throughbore 13 through channels of successively decreasing diameters. The arrangement of channels within the cementing pod 1 may eliminate any preferential flow paths, ensuring a homogenous cementing operation.

Fluid communication between the base tubular joint 7 and the cementing pod 1 is achieved via a communicating port 19, which may be a circular hole in the base tubular joint 7 through which fluid may flow. In one or more embodiments, the communicating port may be 1 inch in diameter. In one or more embodiments, a burst disc (not pictured) is utilized to seal off the communicating port 19, which allows the cementing pod 1 to be run down hole with isolation packers and other completion tools which require pressure for activation. In one or more embodiments, a solid fill 21 is disposed at one end of the cementing pod 1, such that a seal is formed between the cementing pod 1 and the base tubular joint 7 which further forces the flow of cement in a single direction through the cementing pod 1 and prevents the flow of cement below the cementing pod 1.

Figure 2A:
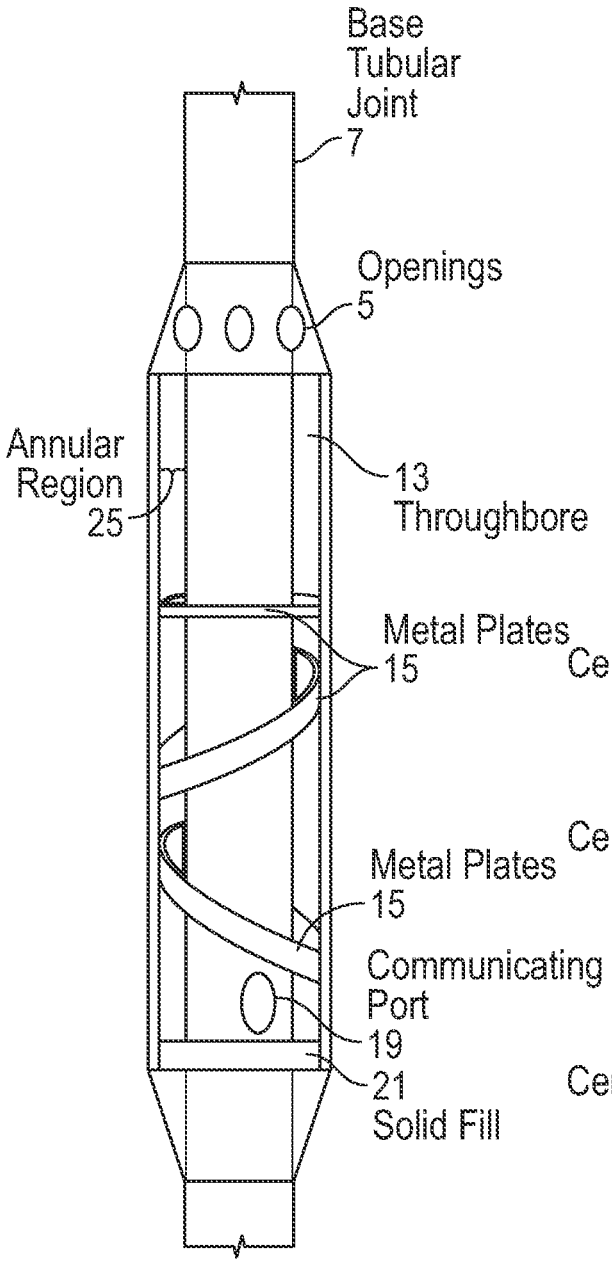
FIGS. 2A and 2B show an off-bottom cementing assembly during a cementing operation in accordance with one or more embodiments.
Figure 2B:
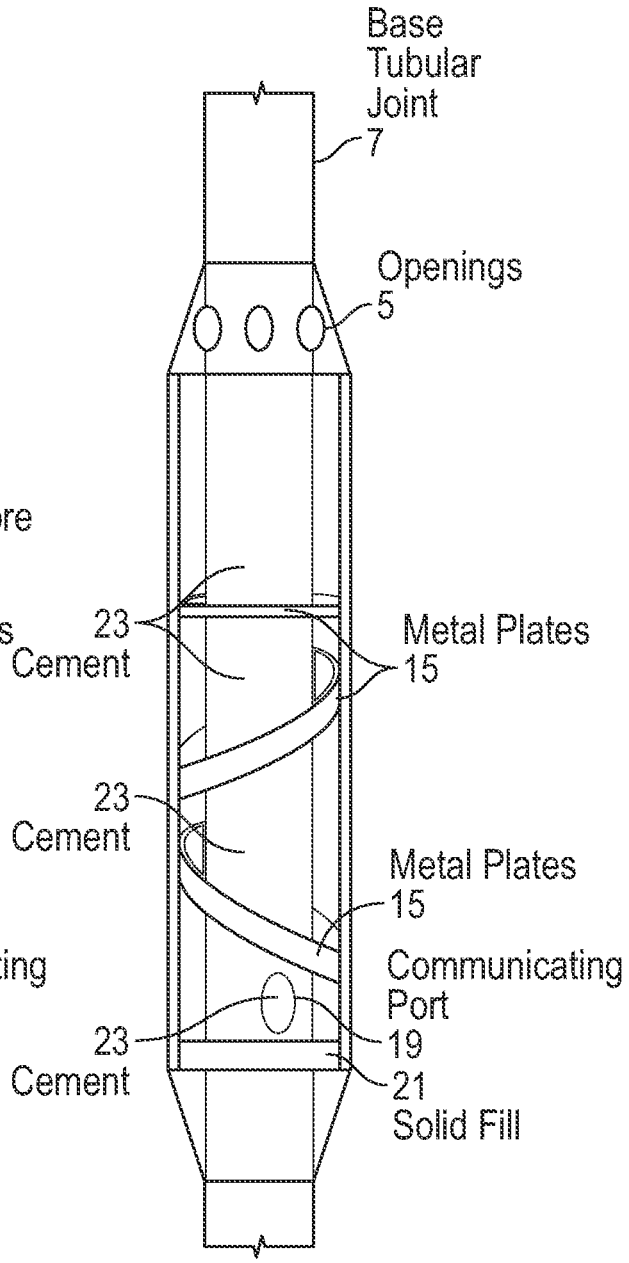

Turning now to FIGS. 2A and 2B, FIG. 2A depicts an off-bottom cementing assembly in accordance with one or more embodiments before the cementing operation, and FIG. 2B depicts an off-bottom cementing assembly in accordance with one or more embodiments after the cementing operation. As shown in FIG. 2A, the cementing pod 1 is oriented around the base tubular joint 7 such that the communicating port 19 is located just above the solid fill 21. During cementing operations, cement 23 is pumped down the base tubular joint 7 and through the communicating port 19. Cement 23 then flows through the space between the base tubular joint 7 and the throughbore 13, which may be referred to as an annular region 25. The channels formed by the plurality of metal plates 15 may force the flow of cement around the annular region 25 in such a way that cement distribution through the annular region 25 is homogenous. As shown in FIG. 2B, after primary cement pumping has been completed, the cement 23 may harden within the annular region 25, sealing off the cementing pod 1, which may provide string integrity and isolation from the wellbore in which the string is disposed.

Figure 3:
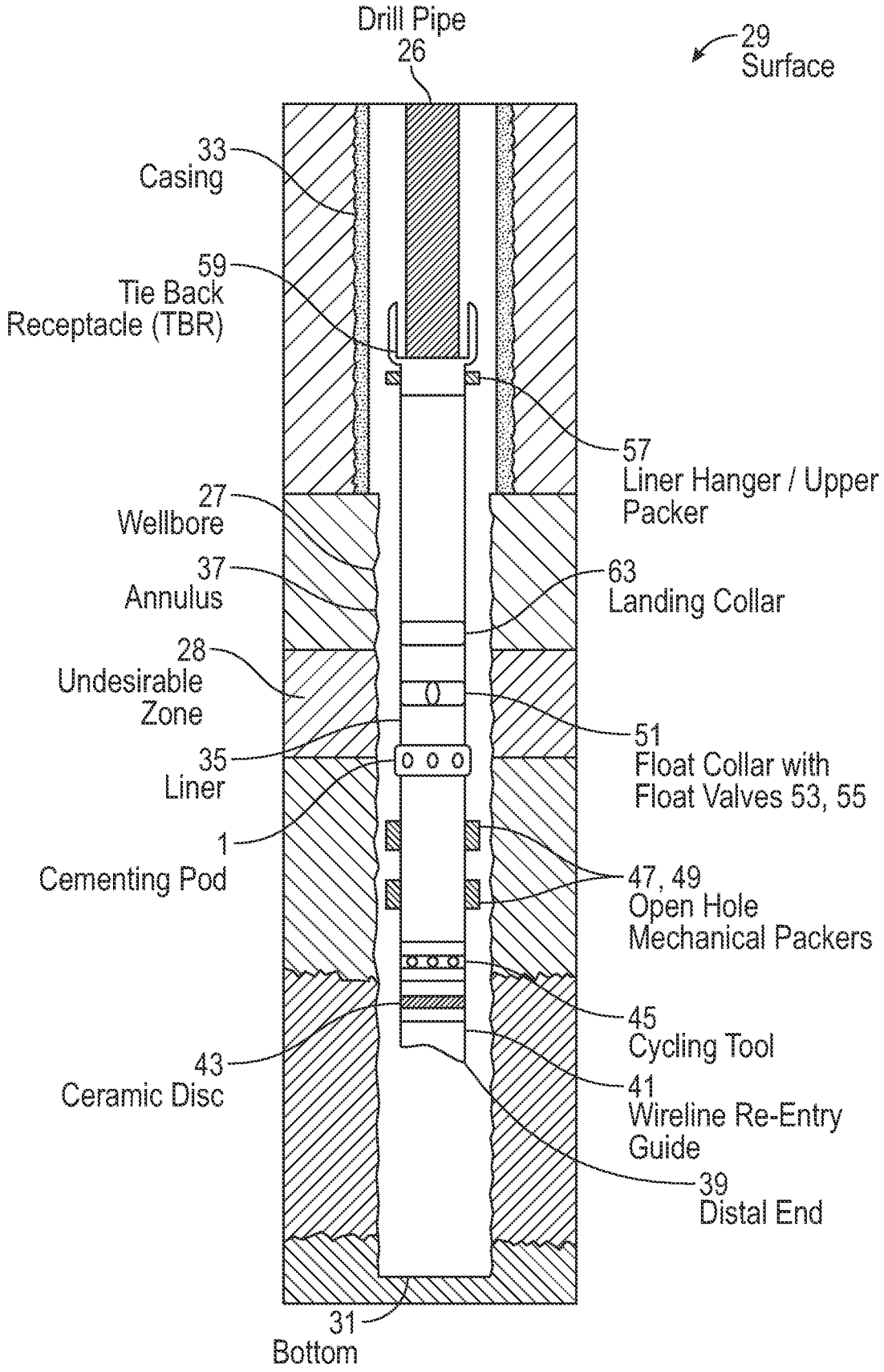
FIG. 3 shows a cementing pod integrated into a conventional off-bottom cementing system in accordance with one or more embodiments.

FIG. 3 depicts a cementing pod 1 integrated into an off-bottom cementing system for a one-trip off-bottom cementing operation in accordance with one or more embodiments. The off-bottom cementing system depicted in FIG. 3 is a well that includes a wellbore 27. The wellbore 27 is a hole drilled into the surface 29 of the Earth. The wellbore 27 has a bottom 31 defined by the deepest-most point (within the Earth) that the wellbore 27 reaches. A casing string 33 has been run in hole and cemented in place prior to the current wellbore 27 having been drilled. The current wellbore 27 is drilled, which includes drilling out the casing shoe accessories of the casing string 33 and drilling a new hole into the rock. After the wellbore 27 has been drilled, a liner string 35 is run into the well at the end of a drill pipe 26, and set off bottom 31 as shown in FIG. 3, such that the cementing pod 1 is in line with an undesirable zone 28 within the wellbore 27.

The liner string 35 has an annulus 37 located between the outer surface of the liner string 35 and the inner surface of the wellbore 27. The annulus 37 is also located between the outer surface of the liner string 35 and the inner surface of the casing string 33. The liner string 35 has a distal end 39. The distal end 39 is the end of the liner string 35 closest to the bottom 31.

In one or more embodiments, the liner string 35 may contain the following components in order, from bottom to top: a wireline re-entry guide 41, a ceramic disc 43, a cycling tool 45, a first open hole packer 47, a second open hole packer 49, the cementing pod 1, a float collar 51 with a first float valve 53 and a second float valve 55, a landing collar 63, and a liner hanger with upper packers 57. Contrary to current systems, in embodiments of a one-trip off-bottom cementing operation with a cementing pod 1, the landing collar 63 does not require a ball catcher. In one or more embodiments, the cementing pod 1 may include a burst disc (not pictured), which may seal the communicating port 19. The listed components may be separated by liner tubular pup joints or liner tubular joints. Liner tubular pup joints refer to joints in the liner string which are shorter than normal joint sections. Liner tubular joints refer to regular sized joints disposed between components in a liner string. Joint sections make up the remainder of the liner string 35 and may be threadably connected to one another and components. Liner tubular joints may be large diameter pipes and may be fabricated from a durable material. In one or more embodiments, the liner tubular joints may be fabricated from steel.

A wireline re-entry guide 41, as one skilled in the art will be aware, may be used to guide the liner string 35 back into casing string 33 and is threadably connected to the bottom end of the liner string 35. A ceramic disc 43 may be used to block the flow path through the liner string 35 and may be broken easily by fluid pressure or a tool. A cycling tool 45 refers to a tubular with ports on the side which may open and close due to pressure generated by fluid flow rate through the tubular. The ports may be closed by increasing the pumping rate. The cycling tool 45 and operation thereof, as one skilled in the art will be aware, is a standard tool and operation method. A first and second open hole packer 47, 49 may be used to isolate the bottom 31 of the well. The first and second float valves 53, 55 are integral check valves installed on the float collar 51 that allow fluid to flow in one direction within the liner string 35, the direction being from the surface 29 to the distal end 39. The float valves 53, 55 prevent reverse flow of fluid or U-tubing of fluid from entering the inside of the liner string 35. The float collar 51 may also have profiles for cement plugs to seat in, and the float collar 51 may be made of the same materials as the liner string 35. The liner hanger and upper packer 57 may be located at the top of the liner string and may reduce stress in the casing string 33.

The space between the distal end 39 of the liner string 35 and the bottom 31 of the wellbore 27 is called the open hole. The open hole may vary in length from 200 feet to 5,000 feet, depending on well orientation. The open hole may be shorter in vertical/low inclination wells than in horizontal wells, for example. Therefore, systems and methods that allow a casing string, which has been set off bottom 31, to be cemented without having to completely fill up the open hole, such as implementation of a cementing pod 1, are beneficial.

Figure 4A:
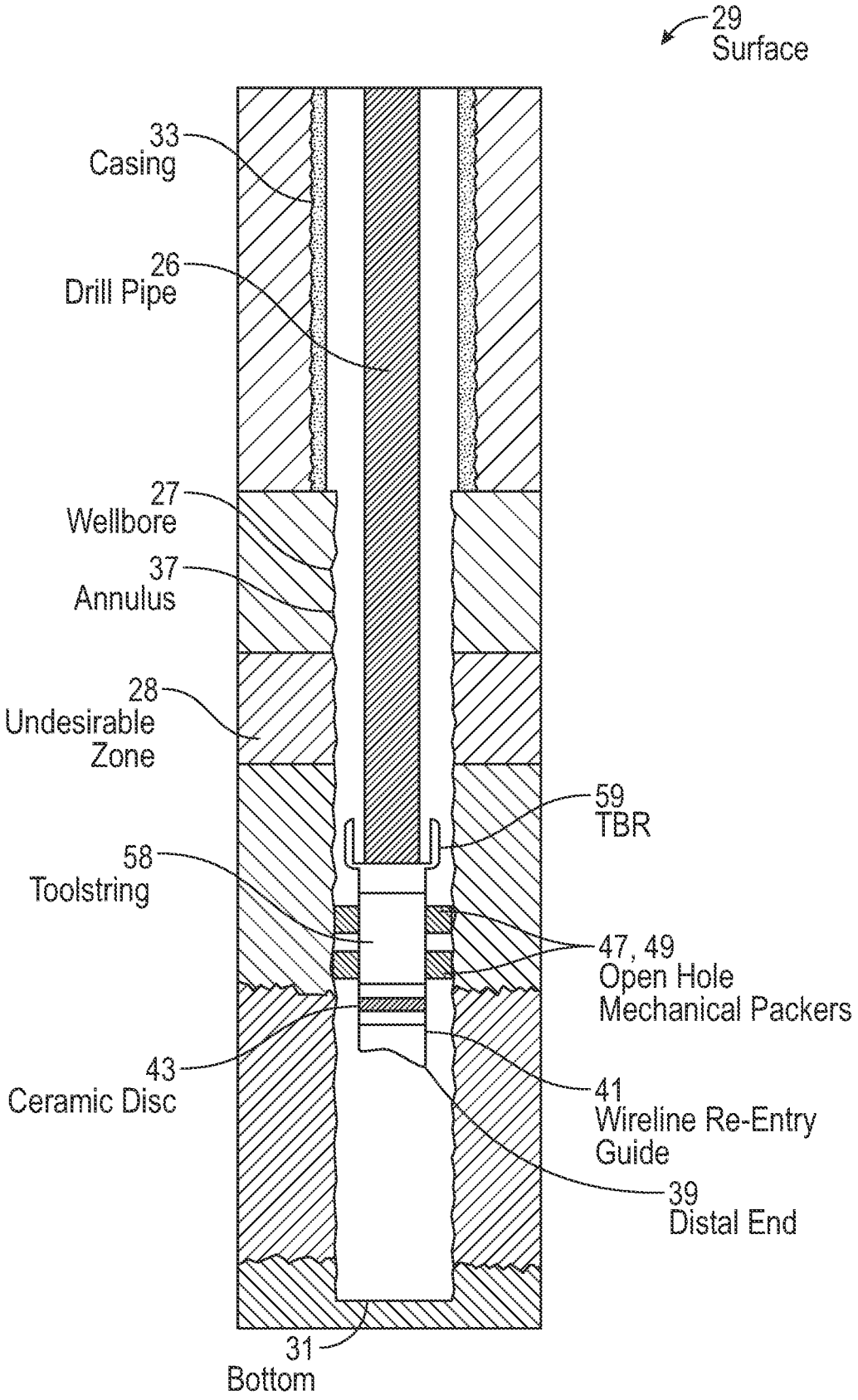
FIGS. 4A and 4B show a cementing pod integrated into a two trip off-bottom cementing system in accordance with one or more embodiments.
Figure 4B:
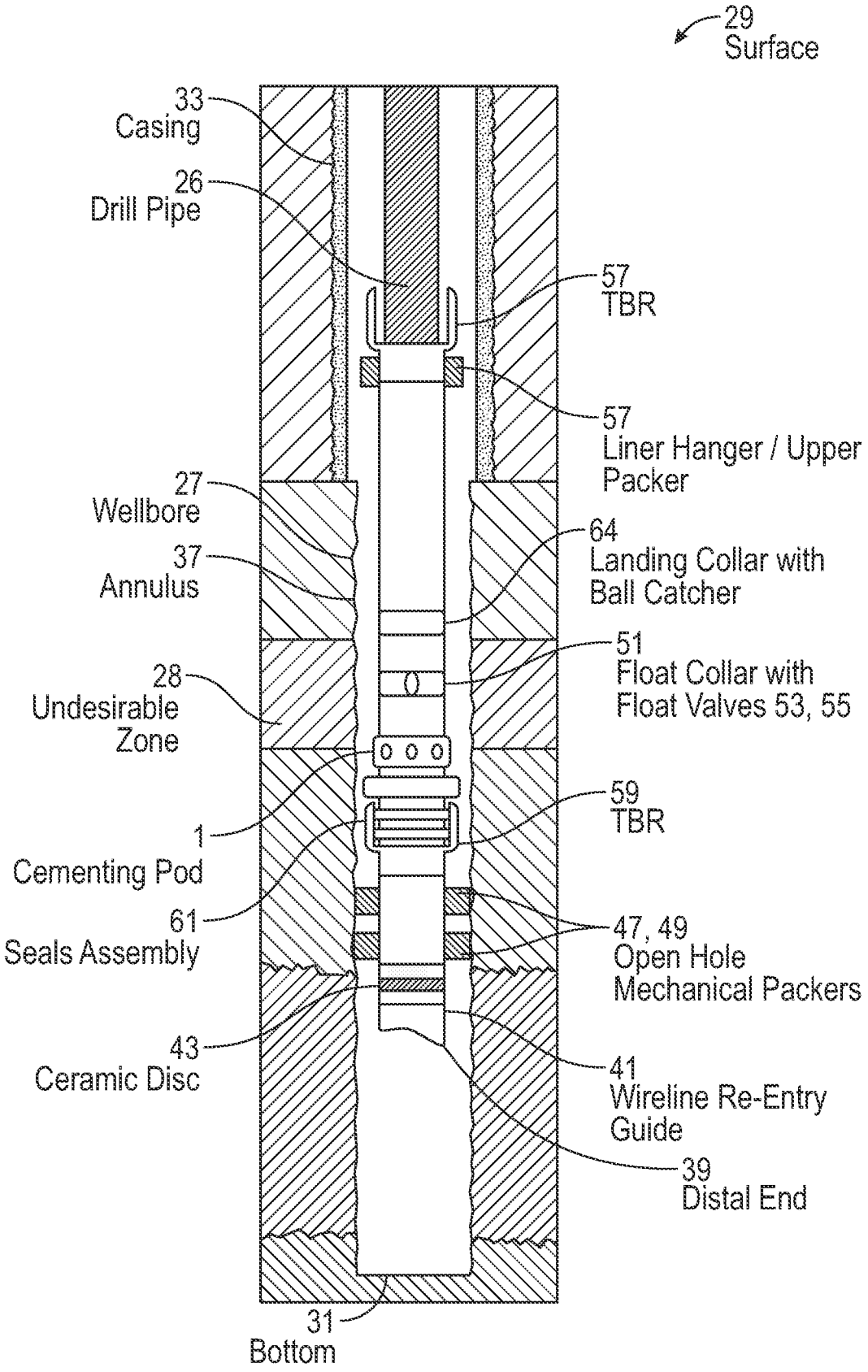

In one or more embodiments, it may be preferable to perform off-bottom cementing operations in two downhole trips instead of one. FIGS. 4A and 4B depict a two trip off-bottom cementing operation in accordance with one or more embodiments. More specifically, FIG. 4A depicts the first trip and FIG. 4B depicts the second trip. During the first trip, as shown in FIG. 4A, a toolstring 58 is run down hole, where the toolstring 58 comprises a wireline re-entry guide 41, a ceramic disc 43, first and second open hole packers 47, 49, and a tie back receptacle 59. A tie back receptacle 59, as one skilled in the art will be aware, may be used to sting in the liner string 35. Liner tubular pup joints and liner tubular joints may be located between components to complete the toolstring 58.

Once the first and second packers 47, 49 have been installed, the toolstring 58 may be removed from the wellbore 27 and a liner string 35 may be run into the wellbore 27, as shown in FIG. 4B. In one or more embodiments, the liner string 35 may comprise a seal assembly with re-entry guide 61, a cementing pod 1, a float collar 51 with a first and second float valve 53, 55, a landing collar with a ball catcher 64, and a liner hanger and upper packer 57. Another tie back receptacle 59 may complete the liner string 35. The seals included in the seal assembly with re-entry guide 61 are stung inside the tie back receptacle 59, allowing the cementing procedure to proceed. The landing collar with ball catcher 64 refers to a component within the liner string 35 upon which cementing plugs land during primary cementing operations. Liner tubular pup joints and liner tubular joints may be located between components to complete the liner string 35.

Figure 5A:
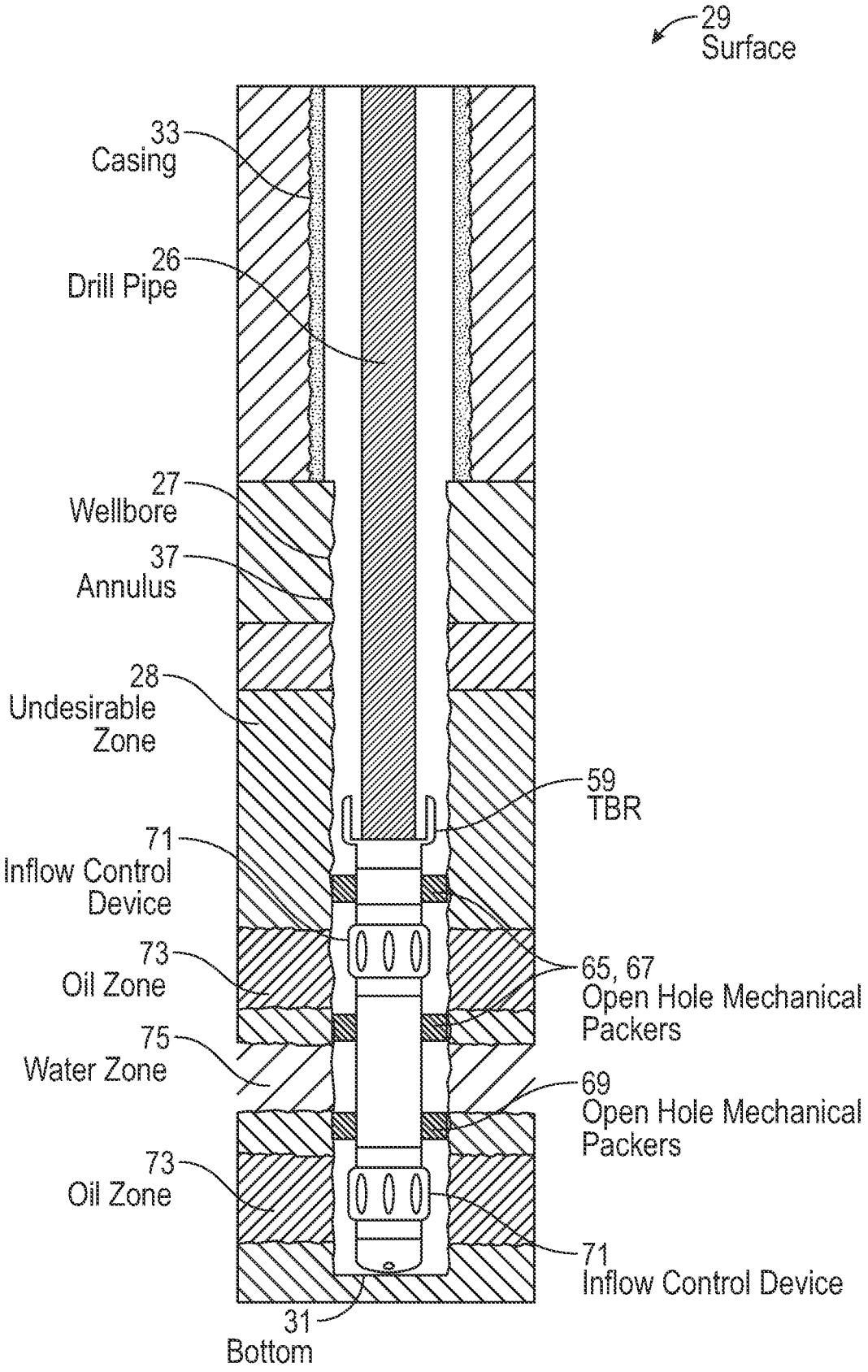
FIGS. 5A and 5B show a cementing pod integrated into a two trip off-bottom cementing system with lower completion in accordance with one or more embodiments.
Figure 5B:
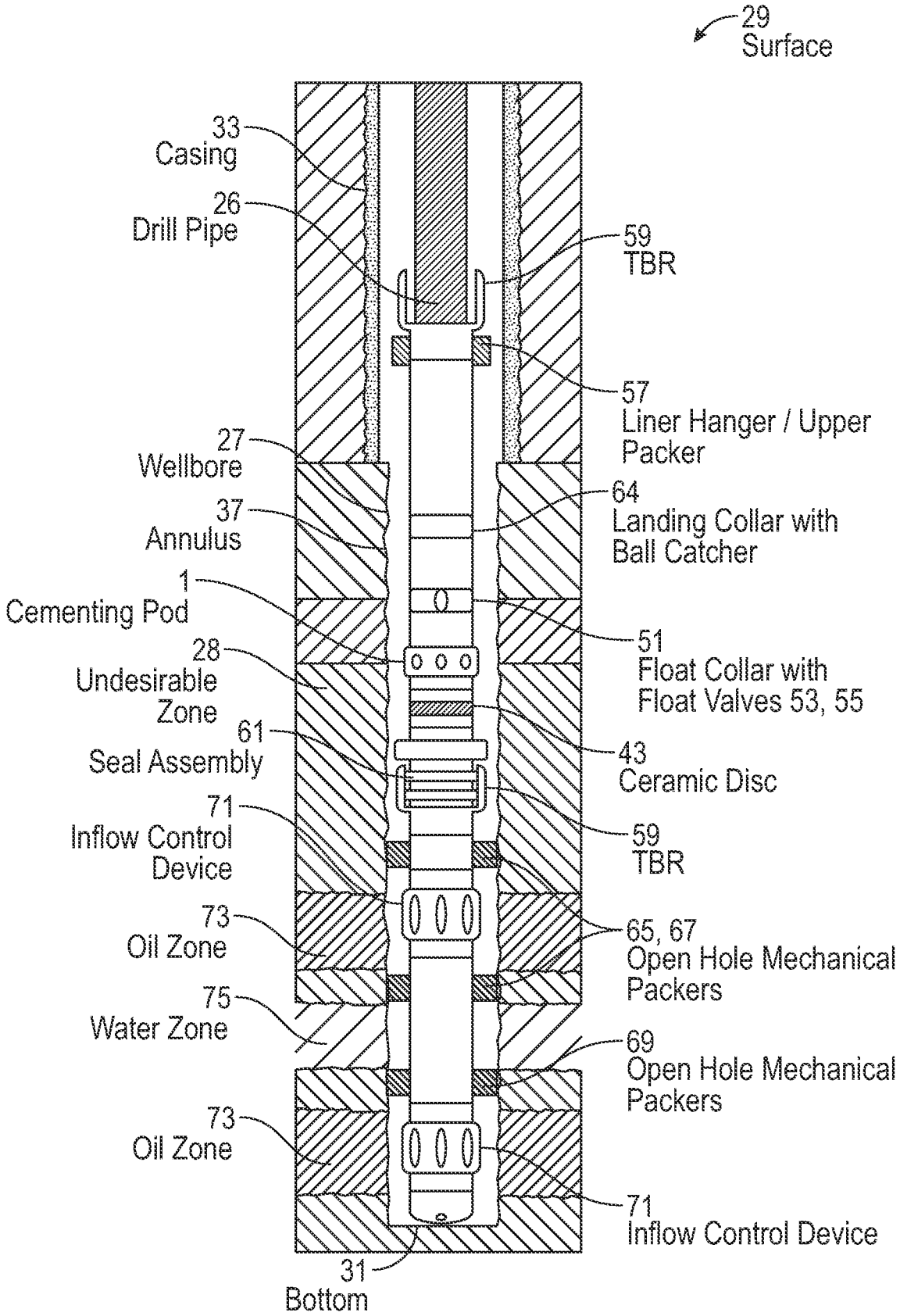

In one or more embodiments, it may be preferable to perform off-bottom cementing in two trips, where the first trip includes equipment for lower completion, as shown in FIGS. 5A and 5B, where FIG. 5A depicts the first trip and FIG. 5B depicts the second trip. Lower completion may be required, for example, in situations where the reservoir or payzone has different intervals, which is particularly common in horizontal well orientations. In one or more embodiments, for example, the different intervals may be a combination of oil zones 73 and water zones 75, as shown in FIG. 5A. In these situations, it is necessary to complete the well in a manner which isolates the water zones 75 from the oil zones 73 within the payzone. As depicted in FIG. 5A, the first trip may include a toolstring which includes all required completion tools, as well as a tie back receptacle 59, which may sting in with the off-bottom liner. In one or more embodiments, the toolstring may include inflow control devices 71 and plurality of open hole packers, 65, 67, 69, which assist in isolating the various zones. For example, the toolstring is lowered into the wellbore 27 such that inflow control devices 71 are in line with oil zones 73, and open hole packers 65, 67, 69 are located between oil zones 73 and water zones 75 to provide appropriate isolation.

The second trip, as shown in FIG. 5B, may comprise a liner string 35 run down hole following lower completion. In one or more embodiments, the liner string 35 may include a seal assembly with re-entry guide 61, a ceramic disc 43, a cementing pod 1, a float collar 51 with a first and second float valve 53, 55, first and second open hole packers 47, 49, a landing collar with ball catcher 63, and a liner hanger and upper packer 57. In particular, the cement may be isolated from the reservoir with the open hole packers 47, 49, the seal assembly 61, and the ceramic disc 43. The seal assembly 61 may be run with an orifice between the top seals to allow stinging in without pressurizing the compartment between the ceramic disc 43 and the low completion.

Figure 6:
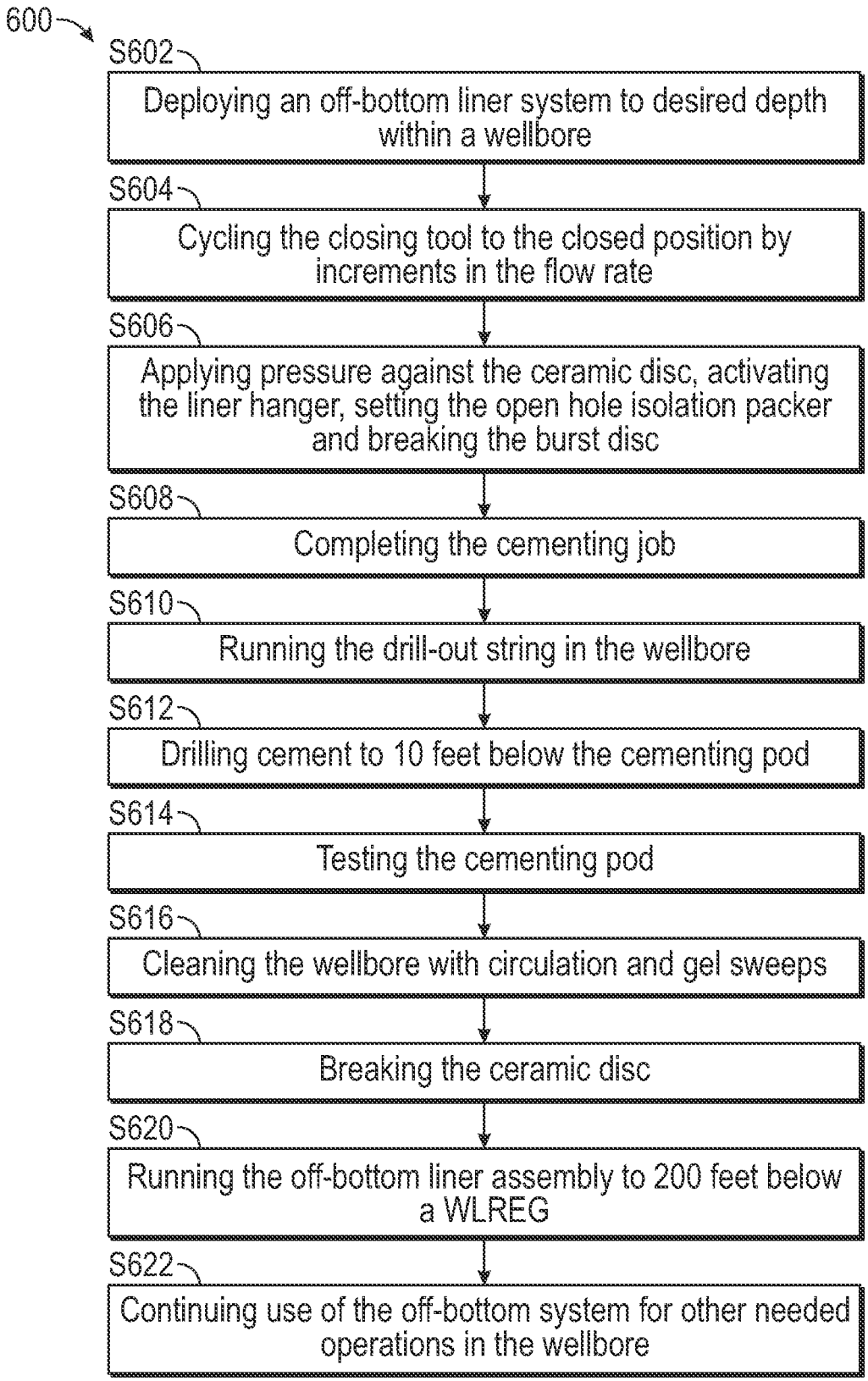
FIG. 6 shows a flowchart of a one trip off-bottom cementing method in accordance with one or more embodiments.
Figure 7:
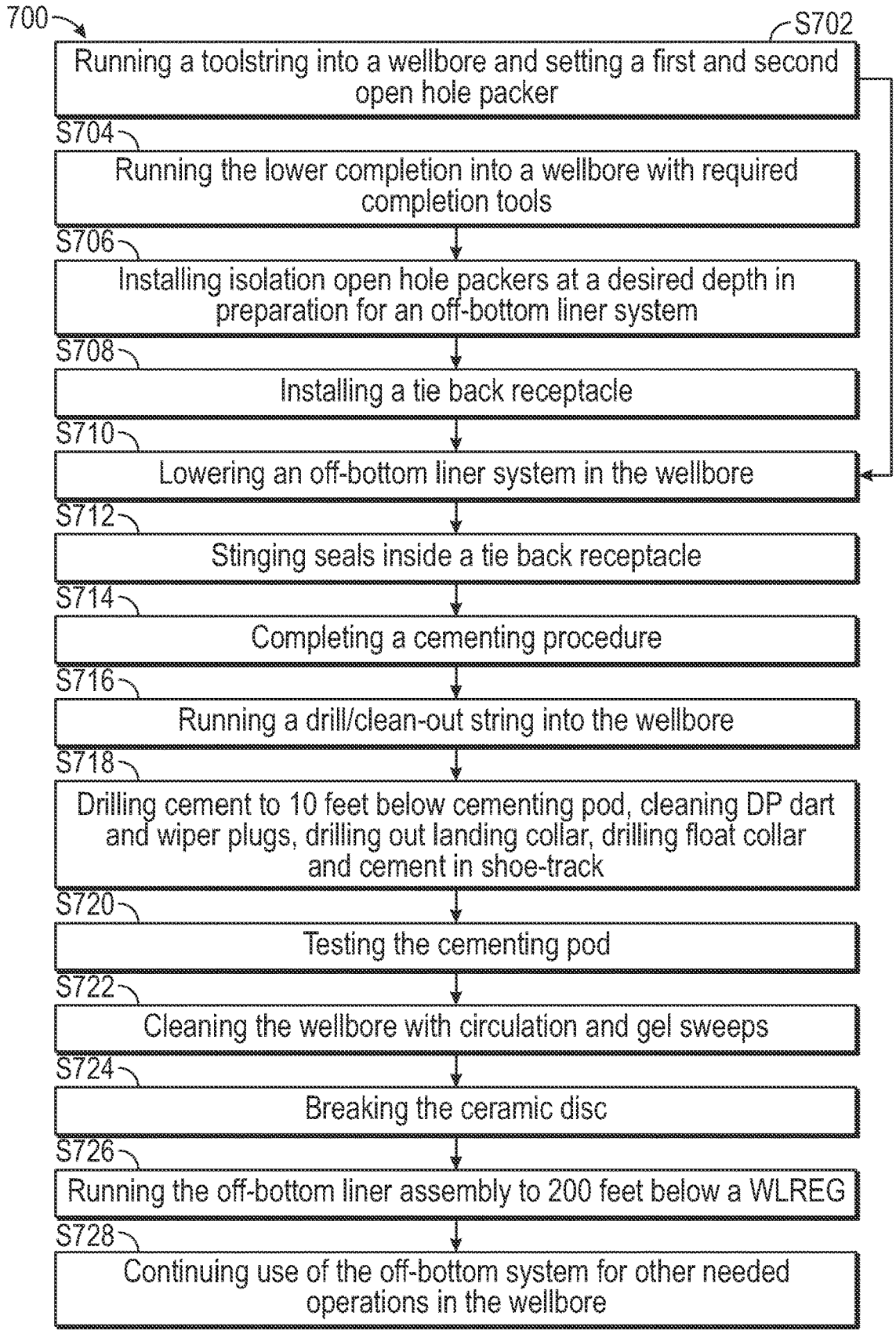
FIG. 7 shows a flowchart of a two trip off-bottom cementing method in accordance with one or more embodiments.

FIGS. 6-7 depict flowcharts in accordance with one or more embodiments. More specifically, FIG. 6 depicts a flowchart 600 of a one trip off-bottom liner cementing method and FIG. 7 depicts a flowchart 700 of a two trip off-bottom liner cementing method. Further, one or more blocks in FIGS. 6-7 may be performed by one or more components as described in FIGS. 1-5. While the various blocks in FIG. 6-7 are presented and described sequentially, one of ordinary skill in the art will appreciate that some or all of the blocks may be executed in different orders, may be combined, may be omitted, and some or all of the blocks may be executed in parallel. Furthermore, the blocks may be performed actively or passively.

Turning now to FIG. 6, initially, an off-bottom cementing system, as depicted in FIG. 3, may be deployed to a desired depth within a wellbore 27, S602. The cycling tool may be cycled to a 'closed position' by increments in the fluid flow rate through the liner string 35, closing the system, S604. The cycling tool may allow for a buildup of pressure against the ceramic disc 43 within the liner string 35, which may assist with establishing circulation for cementing operations. The liner hanger 57 may be activated, the first and second open hole packers 47, 49 may be set, and the burst disc within the cementing pod 1 may be broken, allowing fluid communication between the base tubular joint 7 and the throughbore 13, S606. The cementing procedure may then be completed, S608. The cementing procedure includes pumping cement down hole through the liner string 35, such that cement flows down through the base tubular joint 7 and through the communicating port 19 into the annular region 25. In one or more embodiments, darts and wiper plugs may also be pumped down hole during the cementing procedure. Once the cementing procedure is complete, the cement within the cementing pod 1 may harden. The first and second float valves 53, 55 may prevent any backflow of cement. The upper packer 57 may be mechanically set in the wellbore 27 using the weight of the liner string 35.

Upon completion of the cementing procedure, a drill out string may be run into the wellbore 27, S610. Cement 23 may be drilled or cleaned on top of the float collar 51 and plugs, which may have been pumped down hole along with cement. Cement 23 may further be drilled to 10 feet below the cementing pod 1, S612.

The cementing pod 1 may then be tested, S614. In one or more embodiments, the cementing pod be tested more than once. For example, a positive test may first be performed, and then a negative test may be performed once a satisfactory positive test has been achieved. In one or more embodiments, a positive test may refer to the pressure testing of the liner string 35. Hydraulic pressure may be applied to the liner up to a predetermined value to ensure that the openings 5 of the cementing pod 1 were effectively sealed by cement. Hydraulic pressure may be applied by either a rig pump or a cementing unit, for example. Pressure should hold against the ceramic disc 43 and all other components being tested. In situations where the pressure does not hold, the cement may not have hardened properly, which may create a channel, for example. In such situations, this may be repaired by squeezing more cement through the leak path.

Once a satisfactory positive test has been achieved, a negative test may then be performed, particularly if required by high pressure zones behind the cemented off-bottom liner string 35. In one or more embodiments, a negative test, which may also be referred to as an inflow test, may include creating a lower pressure condition within the liner string 35, such that the interior pressure is less than the formation pressure of the formation behind the cemented liner string 35. If a leak exists, the formation may flow into the wellbore, creating an influx which may be detected at the surface when measuring volumes returning from the well. If the cementing pod 1 is appropriately cemented in place, the well would be completely static, with no production from the formation. If the well does produce fluids, the leak may be repaired with a squeeze cementing job or by applying a casing patch across the openings 5 of the cementing pod 1.

Once the cementing pod 1 has been successfully tested, the wellbore 27 may be cleaned with circulation and gel sweeps, S616. The ceramic disc 43 may then be broken, S618. In some embodiments, the ceramic disc 43 may be broken using fluid pressure. In other embodiments, the ceramic disc 43 may be broken using a tool. The drill out string may then be run 200 feet below the wireline re-entry guide 41, S620. The off-bottom cementing system may remain in the wellbore 27 for continued use in other needed operations in the wellbore 27, S622.

Turning now to FIG. 7, a two trip off-bottom liner cementing method is depicted. In some situations, it may be prudent to run two toolstrings into the wellbore in two separate trips—the first trip may isolate the open hole below the undesirable interval and may prepare the wellbore for the cementing job, and the second trip may perform the cementing job. In one or more embodiments, a toolstring 58 may be lowered into the wellbore 27 prior to the off-bottom liner system. In such embodiments, initially, the first and second open hole packers 47, 49 are run into the wellbore 27 along with a toolstring 58, S702. As shown in FIG. 4A, the toolstring 58 may include a tie back receptacle 59. In other embodiments, lower completion equipment may be run into the wellbore 27 in place of the toolstring 58, S704. The first and second open hole packers 47, 49 may then be installed at a desired depth in preparation for the off-bottom cementing system, S706. Further, a tie back receptacle 59 may be installed as the last component of the lower completion string, S708. Once the toolstring 58 or lower completion equipment have been removed, an off-bottom liner system is run into the wellbore 27, S710. Seals located within a seal assembly 61 are stung inside the tie back receptacle 59, S712. Following stinging seals, a cementing procedure may be completed, S714. In one or more embodiments, a burst disc is not installed on the cementing pod 1, so that cement may flow without restriction from the base tubular joint 7 to the throughbore 13. Following completion of the cementing procedure, a drill out string may be run into the wellbore 27, S716.

Cement 23 may be drilled out to 10 feet below the cementing pod 1, S718. Cementing plugs, darts, landing collar 63, and float collar 51 may also be drilled out. The cementing pod may then be tested for integrity, S720. If needed, a squeeze remedial job may be completed. Once the cementing pod 1 has been successfully tested, the wellbore 27 may be cleaned with circulation and gel sweeps, S722. The ceramic disc 43 may then be broken, S724. The drill out string may then be run 200 feet below the wireline re-entry guide 41, S726. The off-bottom cementing system may remain in the wellbore 27 for continued use in other needed operations in the wellbore 27, S728.

Embodiments of the present disclosure may provide at least one of the following advantages. The use of a cementing pod eliminates the need to drill out components below the cementing pod and the cemented portion of the casing. This therefore eliminates the risk of backing-off or disconnecting the liner while drilling out the float equipment, which can be especially problematic in horizontal wells. Further, use of a cementing pod removes the need to perform clean-out trips to the bottom of the well since no drilling out is required below the cementing pod, which reduces debris which may be left in the wellbore. The installation of float equipment above the cementing pod prevents any u-tube or cement backflow, even if the plug is not bumped.

In contrast to currently existing diverting tools or pressure actuated cementing valves, the cementing pod requires no mechanical parts, which reduces the potential for failures. Use of the cementing pod also requires less items to be drilled out. For example, current diverting tools or pressure actuated cementing valves require a landing seat for a landing ball which activates a stage tool. This one component alone may require at least 4 hours of operation time to be drilled out. As such, limiting the number of components which must be drilled out significantly increases the efficiency and usefulness of off-bottom cementing operations. Further, there is no need for any drill-out operations in the uncemented portion of the off-bottom liner, removing the risk for disconnecting the shoetrack, which can be a time-consuming, costly problem to solve.

The cementing pod may further be combined with standard on-bottom liner cementing equipment or completion equipment. This offers more flexibility and versatility for combining components fabricated by a variety of different providers, increasing the pool of potential suppliers for customers, and reducing costs compared to current off-bottom liner systems. In embodiments where the cementing pod includes a burst disc, the burst disc allows for pressurization of the string, which can be used to set packers or activate completion equipment below the cementing pod.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed:

1. A cementing pod, comprising:

a cylindrical housing with a first end and a second end to enclose a portion of a tubular joint;

a throughbore surrounding the tubular joint and disposed through the cylindrical housing in a first axial direction from the first end to the second end;

a plurality of openings disposed through the cylindrical housing into the throughbore in a second axial direction; and a solid fill disposed at the second end of the cylindrical housing, wherein a plurality of metal plates are disposed around the throughbore, wherein each of the plurality of metal plates is circular and has a central aperture through which the throughbore and the tubular joint extends, and wherein the central aperture separates each of the plurality of metal plates from the tubular joint.

2. The cementing pod of claim 1, wherein the first end and the second end of the cylindrical housing are tapered.

3. The cementing pod of claim 1, wherein the second axial direction is perpendicular to the first axial direction.

4. An off-bottom cementing assembly, comprising:

a base tubular joint with a first end and a second end; and a cementing pod disposed concentrically around the base tubular joint, wherein the cementing pod comprises:

a cylindrical housing with a third end and a fourth end to enclose a portion of the tubular joint, a throughbore surrounding the tubular joint and disposed through the cylindrical housing in a first axial direction from the third end to the fourth end, an annular region disposed between an inner surface of the throughbore and an outer surface of the base tubular joint, a plurality of openings disposed through the cylindrical housing into the throughbore in a second axial direction, a plurality of metal plates disposed within the annular region, a communicating port disposed through the base tubular joint into the throughbore in the second axial direction, and a solid fill disposed at the fourth end of the cylindrical housing, wherein each of the plurality of metal plates is circular and has a central aperture through which the throughbore and the tubular joint extends, and wherein the central aperture separates each of the plurality of metal plates from the tubular joint.

5. The off-bottom cementing assembly of claim 4, wherein the third end and the fourth end of the cylindrical housing is tapered.

6. The off-bottom cementing assembly of claim 4, wherein the second axial direction is perpendicular to the first axial direction.

7. The off-bottom cementing assembly of claim 4, wherein the communicating port further comprises a hole through which the cementing pod and the base tubular joint are fluidly connected.

8. The off-bottom cementing assembly of claim 4, wherein a burst disc is disposed on the communicating port of the cementing pod.

9. The off-bottom cementing assembly of claim 8, wherein the burst disc seals off the communicating port and blocks a fluid connection between the cementing pod and the base tubular joint.

10. The off-bottom cementing assembly of claim 9, wherein the plurality of metal plates creates a plurality of channels through which fluid flows.

11. The off-bottom cementing assembly of claim 10, wherein each of the plurality of channels has an inner diameter.

12. The off-bottom cementing assembly of claim 10, wherein cement flows through the plurality of channels.

13. The off-bottom cementing assembly of claim 10, further comprising:

a plurality of tubular joints, wherein the plurality of tubular joints are arranged above and below the base tubular joint to form a drill pipe;

a wellbore through which the drill pipe extends, wherein the wellbore comprises an upper region and a lower region, the upper region comprising an undesirable interval; and at least two open hole packers installed below the undesirable interval, wherein the two open hole packers are positioned at a boundary between the upper region and the lower region.

14. The off-bottom cementing assembly of claim 13, wherein the base tubular joint is positioned within the wellbore such that the cementing pod is located within the undesirable interval.

15. The off-bottom cementing assembly of claim 14, wherein the lower region of the wellbore is isolated from the upper region, such that fluid flowing through the plurality of channels is contained solely within the upper region.

16. The off-bottom cementing assembly of claim 4, wherein the annular region is one inch in diameter.

17. The off-bottom cementing assembly of claim 4, wherein a coupling is disposed at the first end of the base tubular joint.

18. The off-bottom cementing assembly of claim 4, wherein a pin is disposed at the second end of the base tubular joint.

* * * * *